US005312488A

United States Patent [19]

Bolza-Schünemann et al.

[11] Patent Number: 5,312,488

[45] Date of Patent: May 17, 1994

[54] CROSS GLUING CYLINDER

[75] Inventors: Albrecht Bolza-Schünemann, Coswig; Manfred Kepert, Grosskarlbach, both of Fed. Rep. of Germany

[73] Assignee: Albert-Frankenthal Aktiengesellschaft, Wurzburg, Fed. Rep. of Germany

[21] Appl. No.: 764,721

[22] Filed: Sep. 24, 1991

[30] Foreign Application Priority Data

Sep. 25, 1990 [DE] Fed. Rep. of Germany ..... 4030271
Sep. 4, 1991 [DE] Fed. Rep. of Germany ..... 4129404

[51] Int. Cl.[5] ..... B05C 1/10

[52] U.S. Cl. ..... 118/205; 118/216; 118/244; 118/DIG. 15; 118/419; 101/375

[58] Field of Search ..... 118/205, 216, 244, DIG. 15, 118/419; 156/578, 548; 101/375

[56] References Cited

U.S. PATENT DOCUMENTS

| | | | |
|---|---|---|---|
| 1,047,206 | 12/1912 | Grignard | 101/375 |
| 1,098,060 | 5/1914 | Spiller | 101/375 |
| 1,672,842 | 6/1928 | Wagner et al. | 118/249 |
| 2,583,889 | 1/1952 | Schoonenberg | 101/375 |
| 3,340,804 | 9/1967 | Price, Jr. | 101/375 |
| 4,343,011 | 8/1982 | Murray et al. | 101/375 |
| 4,465,544 | 8/1984 | Fischer et al. | 118/244 |
| 4,742,769 | 5/1988 | Zeller | 101/375 |

FOREIGN PATENT DOCUMENTS

| | | | |
|---|---|---|---|
| 0087724A1 | 9/1983 | European Pat. Off. . | |
| 0209110B1 | 4/1989 | European Pat. Off. . | |
| 1909775 | 2/1973 | Fed. Rep. of Germany . | |
| 2457500 | 6/1976 | Fed. Rep. of Germany | 156/578 |
| 2500174 | 7/1976 | Fed. Rep. of Germany | 118/258 |
| 3525805A1 | 1/1987 | Fed. Rep. of Germany . | |
| 1085252 | 1/1955 | France | 101/375 |
| 60-6464 | 1/1985 | Japan | 101/375 |

OTHER PUBLICATIONS

Translation of French Patent 1,085,252, published Jan. 31, 1955, translated Mar. 12, 1993.

*Primary Examiner*—Karen M. Hastings
*Assistant Examiner*—Todd J. Burns
*Attorney, Agent, or Firm*—Jones, Tullar & Cooper

[57] ABSTRACT

A cross gluing cylinder has spaced peripheral glue application bars which apply glue to a paper web. The overall circumferential length of the cross gluing cylinder can be changed by shifting the glue application bars and cooperating intermediate cylinder sections radially outwardly or inwardly.

6 Claims, 3 Drawing Sheets

CROSS GLUING CYLINDER

FIELD OF THE INVENTION

The present invention is directed generally to a cross gluing cylinder. More particularly, the present invention is directed to a cross gluing cylinder usable to apply glue onto a movable web. Most specifically, the present invention is directed to a cross gluing cylinder having an adjustable circumference. The cross gluing cylinder has two or more circumferentially spaced glue application bars that each apply a transverse bead of glue to a paper web that is passed adjacent the cross gluing cylinder. The glue application bar or bars and intermediate cylinder sections between the bars are radially shiftable to vary the circumferential size of the cross gluing cylinder.

DESCRIPTION OF THE PRIOR ART

It is known generally in the art to utilize a glue application cylinder to apply glue to a paper web or sheet. The glue may be applied to the paper web in a cross or generally transverse direction with respect to the direction of the path of travel of the paper web or sheet to which the glue is being applied. One such generally known cross gluing assembly may be seen in European published unexamined patent application No. 00897724A1.

This prior cross gluing assembly utilizes a gluing cylinder having a constant, fixed diameter and hence circumference. This constant diameter is selected to match the plate cylinder and printing plates carried by the plate cylinder with which the cross gluing cylinder cooperates. However, the fixed circumference cross gluing cylinder of the prior art cannot influence the tension of the web passing by it and cannot accommodate webs having varying thicknesses or paper types.

Another generally known cross gluing assembly may be seen in European patent No. 02 09 110 B1. In this assembly the diameter of the cylinder is changed by using various replaceable inserts. This prior art assembly requires substantial disassembly of the cylinder to change these inserts.

There is thus a need for a cross gluing cylinder whose circumferential size is quickly and easily adjustable. The cross gluing cylinder in accordance with the present invention provides such a device and is a significant advance over the prior art devices.

SUMMARY OF THE INVENTION

It is an object of the present invention to provide a cross gluing cylinder.

Another object of the present invention is to provide a cross gluing cylinder for applying glue onto a movable web.

A further object of the present invention is to provide a cross gluing cylinder having an adjustable circumference.

Still another object of the present invention is to provide a cross gluing cylinder which can influence the tension of a web to which the glue is being applied.

Yet a further object of the present invention is to provide a cross gluing cylinder having radially shiftable glue application bars which are shiftable without the need to replace the gluing cylinder or parts of it.

Even still another object of the present invention is to provide a cross gluing cylinder having rubber spacers between radially adjustable cylinder peripheral segments.

As will be discussed in greater detail in the description of the preferred embodiment which is presented subsequently, the cross gluing cylinder in accordance with the present invention is usable to apply transverse lines or beads of glue to the surface of a moving web. At least one glue application bar is carried by the cylinder and is able to be shifted radially. A plurality of pipe segments or intermediate cylinder periphery forming segments are carried by adjusting disks. Rotatable cam shafts have cam segments that pass through crosshead shoes in the adjusting disks. As each cam shaft is rotated, the cam segments will operate to move the cylinder periphery forming segments radially inwardly or outwardly. The cross glue application bar or bars may be joined to the cylinder periphery forming segments to move radially with them and to thereby change the overall circumference of the cross gluing cylinder.

A primary advantage of the cross gluing cylinder in accordance with the present invention is its ability to influence the web tension between the printing device upstream of the glue applying cylinder and the folder and former downstream of the cross gluing cylinder without the need to substitute one glue cylinder for another or to disassemble the glue cylinder and replace parts in it. When a change is made in, for example, the type of paper web to be used, the thickness of the paper web; or when the tension of the web between the printing unit and the folder is to be changed, the cross gluing cylinder in accordance with the present invention can be adjusted to accommodate such changes. In contrast with prior art cross gluing cylinders, whose circumferential sizes were constant and not adjustable or were adjustable only by replacing inserts or parts, the glue application bar or bars and the intermediate pipe segments or cylinder periphery segments, by being moved radially inwardly or outwardly, allow the overall circumferential size of the cross gluing cylinder to be varied. Thus, whereas the prior art assemblies required the removal of one cross gluing cylinder and the substitution of another cross gluing cylinder having a different size or the use of replacement inserts to change the circumferential size, the cross gluing cylinder of the present invention utilizes its adjustable circumferential size to accommodate web tension changes as well as changes in paper web types and thicknesses.

A further advantage of the cross gluing cylinder of the present invention is the avoidance of creases in the web which may be created by the periodic application of transverse strips or bands of glue to the web.

Yet a further advantage of the cross gluing cylinder of the present invention is the avoidance of dirty corners and corners where glue may have gathered between the cross gluing bars and the guiding faces contacting them. This is because the cross gluing bars can be provided with a curved outer surface that is the same as the curved surface of the guiding faces. The cross gluing bars do not extend beyond the surfaces of the guiding faces of the cylinder periphery and thus avoid the formation of corners and edges where dirt or glue may accumulate.

BRIEF DESCRIPTION OF THE DRAWINGS

While the novel features of the cross gluing cylinder in accordance with the present invention are set forth with particularity in the appended claims, a full and complete understanding of the invention may be had by referring to the detailed description of the preferred embodiment which is presented subsequently and as illustrated in the accompanying drawings in which:

DETAILED DESCRIPTION OF THE PREFERRED EMBODIMENT

Figure 1:
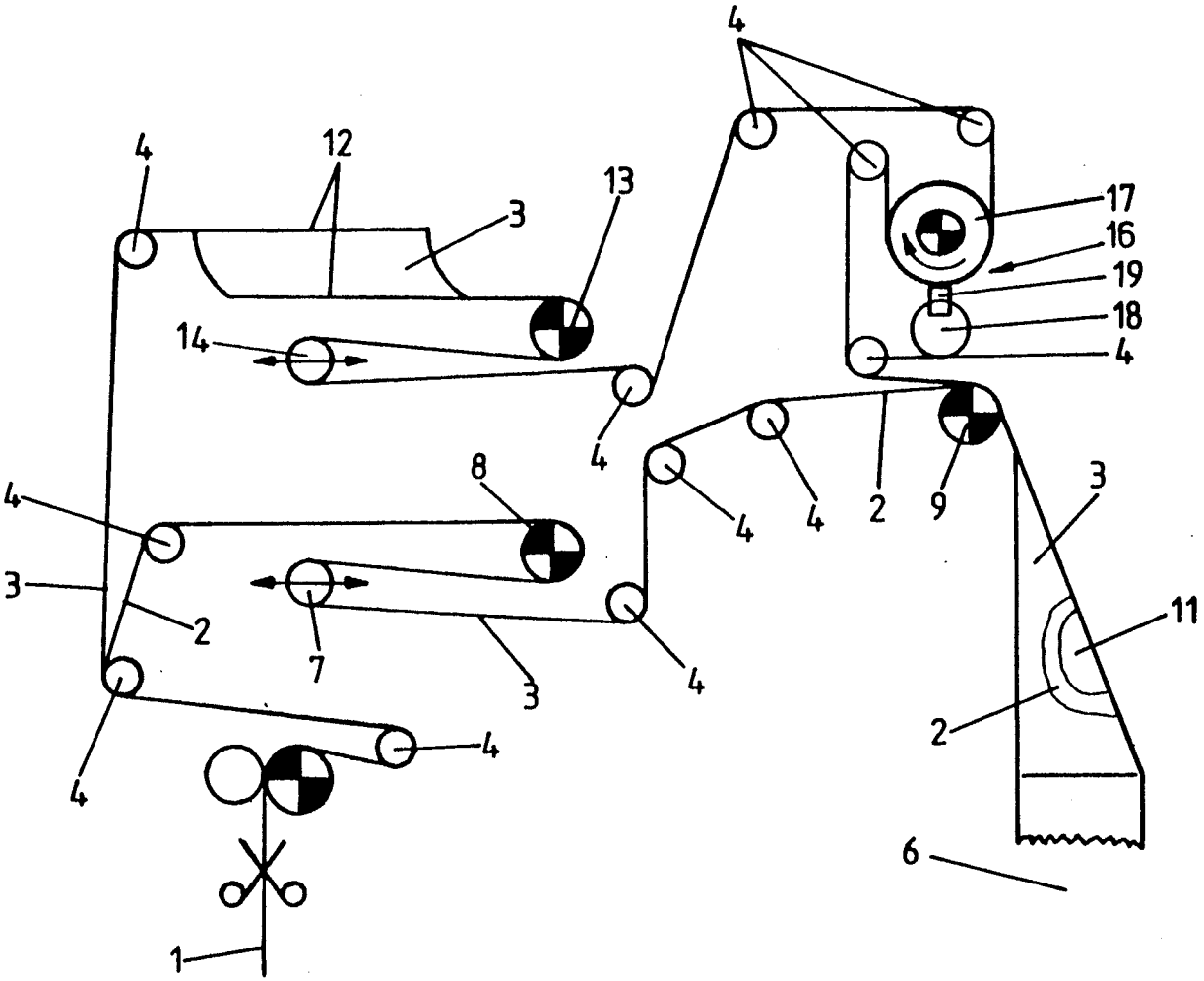
FIG. 1 is a schematic depiction of a printing unit utilizing a cross gluing cylinder in accordance with the present invention and showing the web path of travel between a web slitting device and a former of a folder.

Referring initially to FIG. 1, there may be seen a printing assembly utilizing a cross gluing cylinder assembly, generally at 16, in accordance with the present invention. A paper web 1, which has been printed in a suitable printing unit, which is not shown, is cut or slit into two paper web ribbons 2 and 3. These two ribbons 2 and 3 are then separated and are fed over a plurality of individual paper ribbon guide rollers 4 to a paper web folder assembly that is depicted schematically at 6.

A first paper web ribbon 2 is directed to a first longitudinal register device, generally at 7, after having been directed about a first ribbon drag roller 8 which is torque and/or speed adjustable. The first paper web ribbon 2 then is directed by various other web guide rollers 4 to a folder infeed drag roller 9 which is also capable of torque and speed adjustments. This first paper web ribbon 2 is then passed over a former 11 and into the paper web folder 6.

The second paper web ribbon 3 is passed over suitable paper web guide rollers 4 and is directed to generally well known paper web angle or turning bars 12. These bars 12 shift the path of travel of the second paper web ribbon 3 so that it overlies the path of travel of the first paper web ribbon 2. This second paper web 3 then passes around a second ribbon drag roller 13 which may have an adjustable torque or speed control capability, and to a second longitudinal register device 14. This second paper web ribbon 3 then passes through a cross gluing assembly, generally at 16, in accordance with the present invention and then is placed in overlying relationship with the first paper web ribbon 2 at the folder infeed drag roller 9. The two now superimposed ribbons 2 and 3 are fed to the former 11 and thence go to the folder 6. As the second paper web ribbon passes through the cross gluing assembly 16, it is provided with longitudinally spaced, transversely extending lines or beads of glue which act to hold the first and second paper web ribbons 2 and 3 together as they arrive at the former 11.

As may be seen in FIG. 1, the cross gluing assembly, generally at 16, includes a cross gluing cylinder 17 and a cooperating pressing bar 19 that is supported on a rotatable shaft 18. The cross gluing cylinder 17 and the pressing bar shaft 18 rotate at circumferential speeds which are coordinated to the linear speed of the paper web ribbon 3. The spacing between the axis of rotation of the cross gluing cylinder 17 and the shaft 18 is adjustable. Preferably, the axis of rotation of the cross gluing cylinder 17 is fixed and the shaft 18 is shiftable or adjustable with respect to the cylinder 17.

Figure 3:
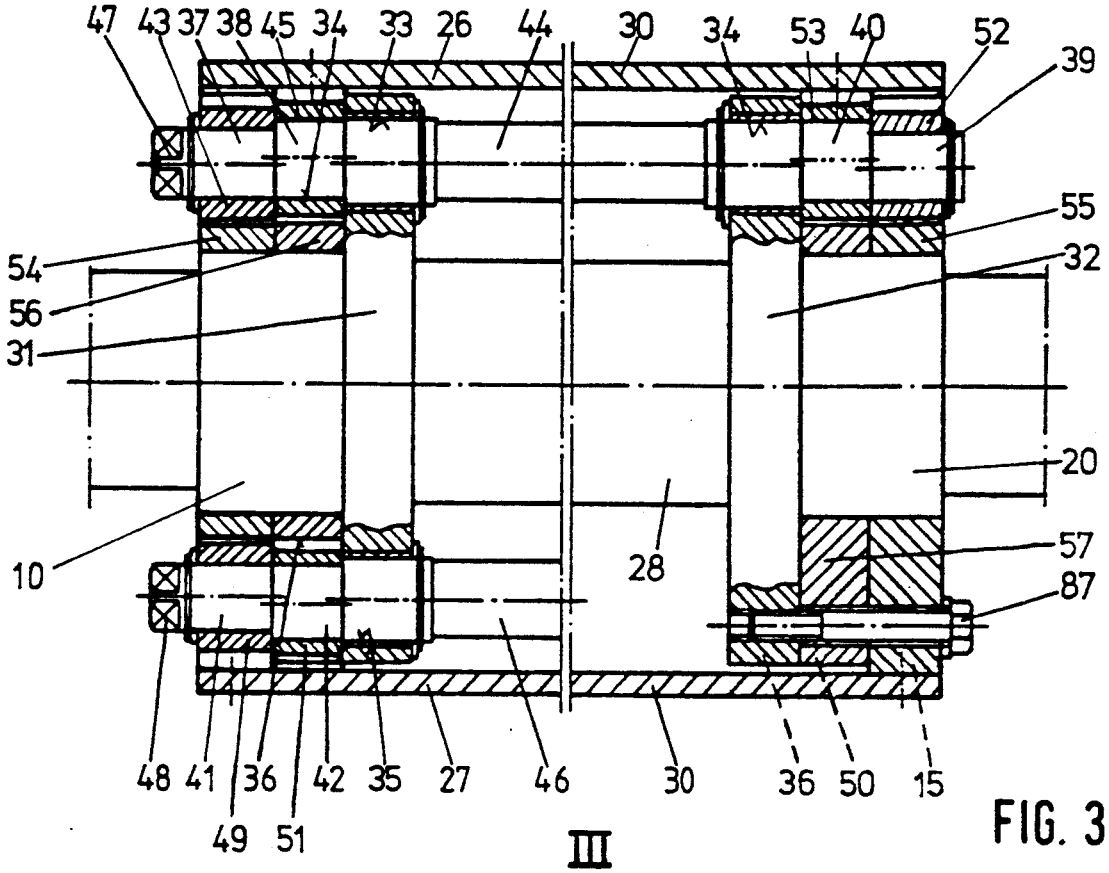
FIG. 3 is a cross-sectional view of the cross gluing cylinder taken along line III—III of FIG. 2.
Figure 2:
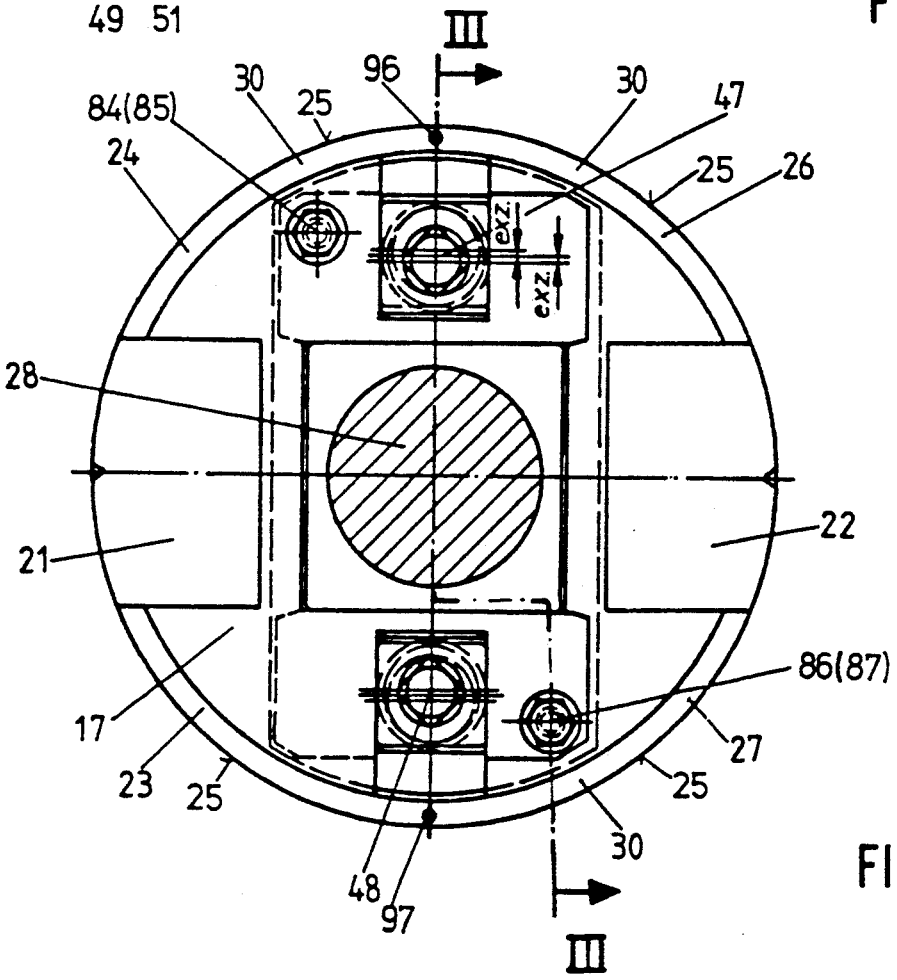
FIG. 2 is an end view of a cross gluing cylinder in accordance with the present invention.
Figure 4:
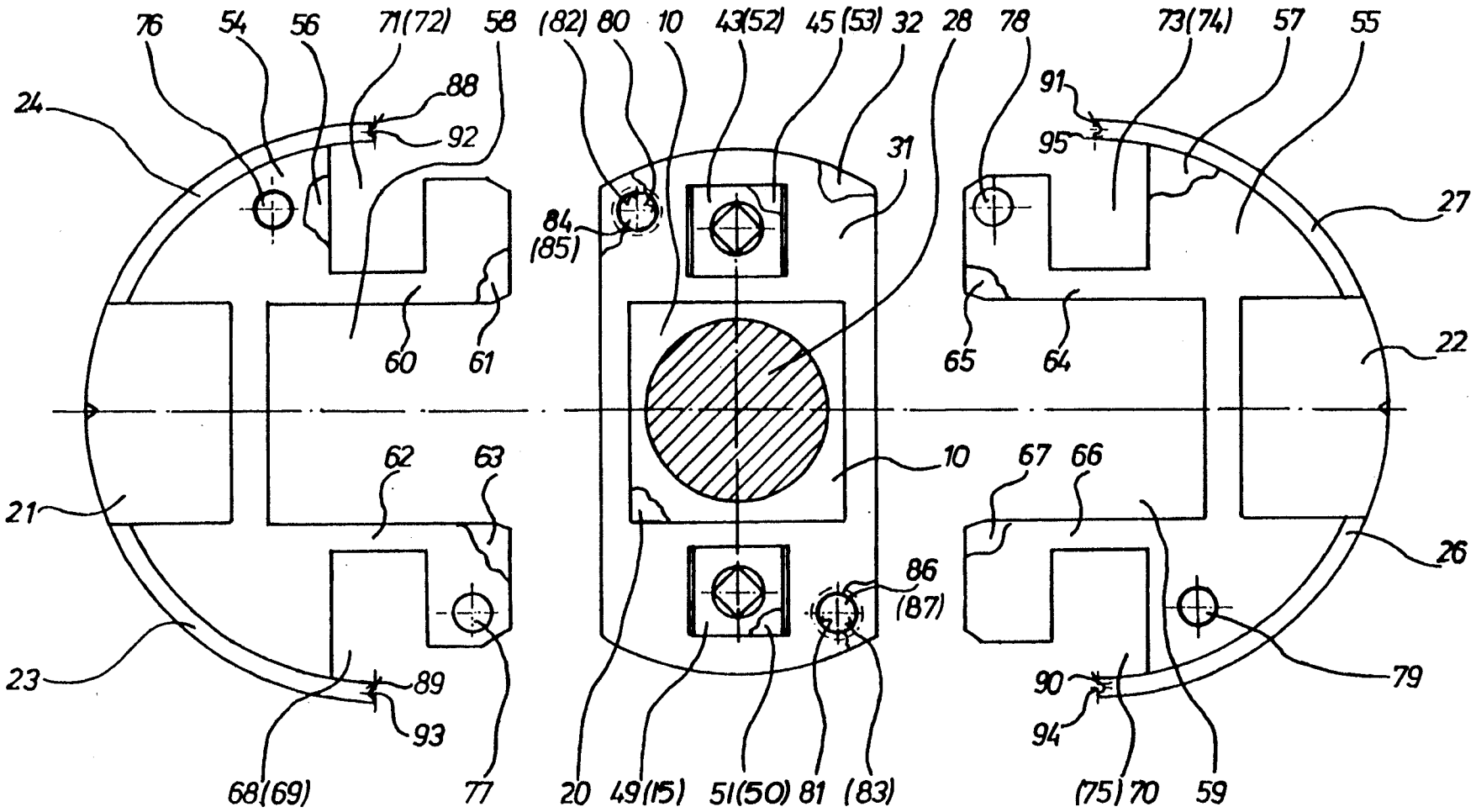
FIG. 4 is an exploded end view of the cross gluing cylinder in accordance with the present invention.

Turning now to FIGS. 2, 3 and 4, there may be seen a preferred embodiment of the cross gluing cylinder 17 which is the subject of the present invention. As indicated previously, the circumferential length or distance 25 of the cross gluing cylinder 17 may be adjusted to accommodate paper web thickness or type changes and the like. As shown in FIG. 2, the cross gluing cylinder 17 supports two radially oppositely spaced and axially extending glue application bars 21 and 22. These two bars are located 180° opposite to each other on the surface of cross gluing cylinder 17. Each of the glue application bars 21 and 22 has an axially extending glue outlet slot on its outer surface. It will be understood that suitable means (not shown) are provided to direct glue to the glue slot in each glue application bar 21 and 22 and further, that cross gluing cylinder 17 will be rotatably supported and driven in any suitable manner.

Cross gluing cylinder 17 is circular in cross-section when it is adjusted to its smallest configuration. This circular cross-sectional shape is defined by the outer surfaces of the two opposed glue application bars 21 and 22 and by a plurality of pipe segments or intermediate cylinder sections 23, 24, 26 and 27 which have convex outer surfaces, which are situated between the glue application bars 21 and 22, and which are securely joined to the glue application bars 21 and 22. As may be seen most clearly in FIG. 2, each of the pipe segments 23, 24, 26 and 27 has the shape of a part of a circle or ring and extends over an angle of less than 90°. Glue application bar 21 is joined to first ends of intermediate cylinder sections 23 and 24 and together extend around up to 180° of the circumference of cylinder 17. In a similar manner, glue application bar 22 is joined to first ends of intermediate cylinder sections 26 and 27 which together form the second segment of up to 180° of the cross gluing cylinder 17.

The circumferential length or line 25 of the cross gluing cylinder 17 is lengthened or shortened by radially outward or inward movement of glue application bar 21 and its associated cylinder sections 23 and 24 together with a similar movement of glue application bar 22 and its associated cylinder sections 26 and 27.

As may be seen most clearly in FIG. 3, and also in FIG. 4, a generally rectangular or cubical guide block 10 is secured, such as by welding, to a first end of a shaft 28. A similar rectangular or cubical guide block 20 is similarly secured to a second end of shaft 28. A first supporting disk 31 contacts an inner surface of guide block 10, is also supported on shaft 28 for rotation therewith, and is generally parallel to the inner surface of the first guide block 10. A second support disk 32 is also secured to shaft 28 for rotation with shaft 28 and contacts an inner face of the second guide block 20. This second support disk 32 is generally parallel to the inner face of the second guide block 20.

Each of the supporting disks 31 and 32 is provided with several spaced bore holes 33 and 35, and 34 and 36, respectively. These bore holes are positioned generally adjacent the outer periphery of each of the supporting disks 31 and 32, as may be seen in FIG. 3. A first cam shaft 44 is rotatably supported in the spaced, aligned bore holes 33 and 34 in disks 31 and 32, respectively. A second cam shaft 46 is supported in the bore holes 35 and 36 in disks 31 and 32, respectively. Cam shaft 44 has a square outer end 47 positioned exteriorly of the cross gluing cylinder. Cam shaft 46 has a similar square end 48. These square ends 47 and 48 can be engaged by a suitable tool, such as a wrench, so that the cam shafts 44 and 46 can be rotated within the bores 33 and 34 or 35 and 36 in supporting disks 31 and 32, respectively.

First cam shaft 44 is provided at a first end adjacent square head 47 with an outer cam 37 and an inner cam 38 with these two cams being situated adjacent each other. A second end of first cam shaft 44 has a similar arrangement of an outer cam 39 and an inner adjacent cam 40. The first end of the second cam shaft 46, adjacent its square head 48 is also provided with adjacent outer and inner cams 41 and 42, respectively, which are located adjacent each other. The second end of second cam shaft 46 also has an inner cam and an adjacent outer cam in a manner the same as the first cam shaft 44. These cams are not depicted in FIG. 2 of the drawings. However, it will be understood that these inner and outer cams at the second end of the second cam shaft 46 will have the same dimensions as cams 39 and 40.

The eccentricity of the outer cams 37, 39, 41 and the similar outer cam not shown on the cam shaft 46, and of the inner cams 38, 40, 42 and the similar inner cam not shown on the cam shaft 46 are all sized to cause suitable movements of generally rectangular shaped crosshead shoes. As seen in FIG. 3, outer crosshead shoes 43 and 52 are carried on outer cams 37 and 39 of first cam shaft 44. Inner crosshead shoes 49 and 15 are carried on outer cam 41 and the second outer cam not shown in the drawings at the second end of second cam shaft 46. Inner crosshead shoes 45 and 53 are carried on the inner cams 38 and 40 of the first cam shaft 44. In a similar manner, inner crosshead shoes 51 and 50 are carried on the inner cam 42 at the first end of the second cam shaft 46 and on the inner cam not represented at the second end of the second cam shaft 46. When the cam shafts 44 and 46 are rotated by the use of suitable wrenches which can engage the square ends 47 and 48, the cams will move the crosshead shoes in suitable directions so that the glue application bars 21 and 22 and their associated pipe segments 23 and 24, and 25 and 26, respectively, will move either toward or away from each other to reduce on increase the circumference 25 of the body 30 of the cross gluing cylinder. It will be understood that the various cams 37, 38, 39, 40, 41, 42 and the two cams not depicted at the second end of the second cam shaft 46 will be received in suitable bores in the various crosshead shoes 43, 45, 52, 53, 49, 51, 15 and 50, as is shown generally in FIG. 3. The two generally semicircular halves of the periphery of the cross gluing cylinder body 30 will thus be moved either closer together or farther apart by suitable rotation of the two cam shafts 44 and 46 as will now be discussed.

Referring now primarily to FIG. 4, an outer adjusting disk 54 is welded or otherwise attached to each end of the cross gluing cylinder body half defined by pipe segments 23 and 24 and the inner three surfaces of the glue application bar 21. An inner adjusting disk 56 is secured to each end of the same body half with each inner adjusting disk 50 being positioned axially inwardly of, and adjacent to, the cooperating outer adjusting disk 54. In a similar manner, an outer adjusting disk 55 and an inner adjusting disk 57 are welded or otherwise secured to the inner surfaces of the cross gluing cylinder body half defined by pipe segments 26 and 27 and the inner three surfaces of the glue application bar 22. Each of these adjusting disks 54, 55, 56 and 57 has the same shape. As seen in FIG. 4, each adjusting disk 54–57 has an open recess 58 or 59 located generally radially inwardly of its associated glue application bar 21 or 22. This open recess 58 or 59 is dimensioned so it will be slidably engageable with a respective one of the generally rectangular guide blocks 10 or 20 secured to shaft 28. This allows the adjusting disks 54–57 to be shiftably supported by the guide blocks 10 and 20.

Each outer adjusting disk 54 has an upper tine 60 and a lower tine 62. Each outer adjusting disk 55 has an upper tine 64 and a lower tine 66. In a similar manner, each inner adjusting disk 56 has an upper tine 61 and a lower tine 63 while each inner adjusting disk 57 has an upper tine 65 and a lower tine 67. The upper outer tines 60 and 64 have guiding recesses 71 and 73, while the lower outer tines 62 and 66 have guiding recesses 68 and 70. In a similar fashion the upper inner tines 56 and 57 have guiding recesses 72 and 74 while the lower inner tines 63 and 67 have guiding recesses 69 and 75. All of these guiding recesses 68–75 are generally square and have one open side. As seen in FIG. 4, the open sides of the upper tine guide recesses open upwardly while the open sides of the lower tine guide recesses open downwardly. All of these guiding recesses are sized to cooperate with an associated one of the crosshead shoes 15, 43, 45, 49, 50, 51, 52 and 53.

In the drawings, the inner crosshead shoes 45, 53, 51 and 50 are depicted as being somewhat larger than the outer crosshead shoes 43, 52, 49 and 15. This is to be understood as being done for purposes of illustration and ease of comprehension. All of the crosshead shoes 15, 43, 45, 49, 50, 51, 52 and 53 are fitted in their respective guiding recesses in a manner such that there is no movement between a crosshead shoe and its associated guiding recess. Thus crosshead shoe 43 is fitted in guiding recess 71, crosshead shoe 52 is fitted in guiding recess 72, crosshead shoe 45 is fitted in guiding recess 73, crosshead shoe 53 is fitted in guiding recess 74, crosshead shoe 49 is fitted in guiding recess 68, crosshead shoe 51 is fitted in guiding recess 69, crosshead show 50 is fitted in guiding recess 70 and crosshead shoe 15 is fitted in guiding recess 75.

Each one of the several adjusting disks is provided with a pair of spaced bore holes. As may be seen in FIG. 4, adjusting disks 54 and 56 are provided with bore holes 76 and 77 while adjusting disks 55 and 57 are provided with bore holes 78 and 79. In an assembled position, as depicted in FIGS. 2 and 3, the boreholes 76 are aligned with the boreholes 78 while the boreholes 77 are aligned with boreholes 79. Further, the boreholes 76 and 78 are aligned with tapped holes 80 and 82 in supporting disks 31 and 32 while the boreholes 77 and 79 are aligned with tapped holes 81 and 83 in the supporting disks 31 and 32.

A threaded screw passes through each pair of aligned boreholes and is received in its respective tapped hole. Thus a screw 84 passes through bore holes 76 and 78 and is received in tapped hole 82. A screw 85 passes through bore holes 77 and 79 and is received in tapped hole 81. A screw 86 passes through bore holes 76 and 78 and is received in tapped hole 80. As may be seen in FIG. 3, screw 87 passes through bore holes 77 and 79 and is received in tapped hole 83 in support disk 32. These screws are used to hold the glue application bars 21 and 22 and their attached pipe sections in a desired adjusted position. The bores 76, 77, 78 and 79 are large enough to allow sliding movement of the adjusting disks on the guide blocks 10 and 20 when the screws are untightened. Once the circumferential size of the cross gluing cylinder body 30 has been adjusted by suitable rotation of the cam shafts 44 and 46 and a resultant movement of the cam sections and their cooperating crosshead shoes to slide the adjusting disks with respect to the guide blocks 10 or 20 to thereby increase or decrease the overall circumferential size of the cross gluing cylinder body 30, the screws can be tightened down in their tapped holes in the supporting disks 31 and 32 to clamp the adjusting disk pairs, such as disks 54 and 56 and disks 55 and 57 together and into engagement with their respective supporting disks 31 or 32 to prevent changes in the size of the cylindrical body 30.

Turning again to FIG. 4, an axially extending face 88 of pipe segment 24 is provided with an elongated groove or slot 92. A similar slot 93 is formed in face 89 of pipe segment 23. A similar groove or slot 94 is formed in end face 90 of pipe segment 26 while a similar semicircular slot or groove 91 is formed in end face 91 of pipe segment 27. These grooves or slots 92–95 each receive a section of rubber cord 96 or 97, as shown in FIG. 2. These rubber cords 96 and 97 are sized so that they are positively and securely received in their associated grooves 92 and 95, and 93 and 94, respectively. When the two glue application bars 21 and 22 are moved radially outwardly to their farthest extent, so that the circumferential size or line 25 of the cross gluing cylinder body 30 is at its maximum, the rubber cords 96 and 97 keep the gap between the faces 88 and 91, and 89 and 90 closed. When the cylinder halves are moved close together, the rubber cords 96 and 97 are compressed within their respective groove pairs 92 and 95, and 93 and 94 so that the circumference or line 25 of the cylinder body 30 can be made as small as possible.

As was discussed above, the cam shafts 44 and 46 can be rotated to move the glue application bar 21 and its associated pipe segments 23 and 24 closer to or farther apart from concurrently moving glue application bar 22 and its pipe segments 26 and 27. In the cross gluing cylinder of the present invention, the maximum spacing of the pipe segments 23 and 26 and of the pipe segments 24 and 27 is approximately 0.7 mm.

While a preferred embodiment of a cross gluing cylinder in accordance with the present invention has been set forth fully and completely hereinabove, it will be apparent to one of skill in the art that a number of changes in, for example, the drive means for the cross gluing cylinder, the type of glue being applied, the overall size of the cylinder and the like may be made without departing from the true spirit and scope of the subject invention, which is accordingly to be limited only by the following claims.

What is claimed is:

1. A cross gluing cylinder usable to apply glue to a movable web comprising:

a rotatable cross-gluing cylinder;

first and second glue application bars supported on a peripheral surface of said cross gluing cylinder, said first and second glue application bars being diametrically oppositely spaced on said peripheral surface of said cross gluing cylinder;

means for radially shifting said first and second glue application bars for varying the circumferential length of said cross gluing cylinder; and a plurality of intermediate cylinder sections cooperating with said spaced first and second glue application bars to form said peripheral surface of said cross gluing cylinder, said intermediate cylinder sections being radially shiftable with said first and second glue application bars.

2. The cross gluing cylinder of claim 1 wherein first ends of said intermediate cylinder sections are secured to said first and second glue application bars.

3. The cross gluing cylinder of claim 2 wherein a rubber cord is positioned between second ends of adjacent said intermediate cylinder sections.

4. The cross gluing cylinder of claim 1 including adjusting disks secured to inner surfaces of said intermediate cylinder sections, said adjusting disks having aligned recesses.

5. The cross gluing cylinder of claim 4 further including cam shafts having cams, said cams being positioned in crosshead shoes in said recesses in said adjusting disks whereby rotation of said cam shafts effects said radial shifting of said cylinder sections.

6. The cross gluing cylinder of claim 5 further including means to clamp said adjusting disks between cooperating spaced supporting disks to retain said intermediate cylinder sections in a selected position.

* * * * *